United States Patent [19]

Steinbach

[11] Patent Number: 4,835,998

[45] Date of Patent: Jun. 6, 1989

[54] REMOVABLE HANDLE FOR T-HANDLE LOCK ASSEMBLY

[75] Inventor: Robert Steinbach, Glendale Heights, Ill.

[73] Assignee: Chicago Lock Company, Chicago, Ill.

[21] Appl. No.: 197,347

[22] Filed: May 23, 1988

[51] Int. Cl.[4] ..... E05B 13/10

[52] U.S. Cl. ..... 70/208; 70/207; 70/224; 70/416; 70/417

[58] Field of Search ..... 411/910, 911; 70/207, 70/208, 224, 416, 417

[56] References Cited

U.S. PATENT DOCUMENTS

| | | | |
|---|---|---|---|
| 3,089,330 | 5/1963 | Kerr | 70/208 X |
| 3,266,275 | 8/1966 | Atkinson | 70/208 X |
| 3,279,838 | 10/1966 | Hamilton | 411/910 X |
| 3,302,434 | 2/1967 | Davenbaugh et al. | 70/208 |
| 3,419,135 | 12/1968 | Millner | 411/910 X |
| 4,132,092 | 1/1979 | Steinbach | 70/208 |
| 4,258,596 | 3/1981 | Bisbing et al. | 411/911 X |
| 4,552,001 | 11/1985 | Roop | 70/208 |

FOREIGN PATENT DOCUMENTS

| | | | |
|---|---|---|---|
| 3030519 | 2/1982 | Fed. Rep. of Germany | 70/207 |
| 3036296 | 5/1982 | Fed. Rep. of Germany | 70/207 |

*Primary Examiner*—Robert L. Wolfe
*Assistant Examiner*—Suzanne L. Dino
*Attorney, Agent, or Firm*—Basil E. Demeur; Robert E. Knechtel; Alan B. Samlan

[57] ABSTRACT

There is disclosed an improved handle assembly which relates to a pop-out T-handle lock assembly of the type having a cylinder front handle which mates with a cylinder housing, which in turn houses a cylinder lock and related extension rod therein.

The improved handle assembly is formed by providing an inner handle secured to the cylinder housing at the front end thereof, the inner handle having a pair of opposed attachment flanges extending outwardly therefrom. Each of the attachment flanges includes a screw receiving channel formed along the inner surface thereof, and the cylinder front handle is provided with a pair of opposed threaded apertures in spaced apart relation traversing side walls thereof and positioned to be in registry with the screw channels formed in the inner handle when the cylinder front handle is mounted to the inner handle. A pair of threaded screws are provided for removably engaging the cylinder front handle to the inner handle, the threaded screws being received through the threaded apertures and through the screw receiving channels formed in the inner handle. The assembly permits the easy removal of the cylinder front handle to gain access to the inner handle and the related cylinder housing and associated lock and extension rod.

4 Claims, 1 Drawing Sheet

REMOVABLE HANDLE FOR T-HANDLE LOCK ASSEMBLY

BACKGROUND OF THE INVENTION

The art field with respect to T-handle lock assemblies is fairly well known. T-handle lock assemblies of this type are commonly used in high security environments, which typically include coin changers, soft drink or food vending machines, mass transit collection systems, outdoor storage facilities, and similar applications. The intended purpose of such high security lock is to prevent unauthorized access to the contents of the related equipment, and prevent theft.

Generally, the pop-out T-handle lock assemblies operate by providing an external handle housing which covers the handle assembly when the cylinder front handle is depressed and lockingly engaged within the confines of the handle housing. In order to operate the lock, the key is inserted in the front key way, and manipulated in order to release the lock bolt which causes the entire handle assembly to pop forward due to the action of a coil spring which forces the entire pop-out handle outwardly. A lock device may then be operated because the extension rod has a screw threaded rear end, and the handle may then be moved in a counter clockwise direction to unscrew the threaded extension rod from the threaded channel in the rear. The locking procedure is simply reversed, with the handle being moved in a clockwise direction to screw threadingly engage the screw threaded extension rod in the threaded channel which is set within the confines of the box to be protected, and when the screw threading engagement has been achieved, the front handle is depressed into the handle housing until the lock bolt engages in the housing channel. In this position, access to the lock from unauthorized sources is prevented.

The prior art has made various attempts at making these types of locks more secure since many improvements have been met with counter systems or procedures to circumvent the improvements. In addition, while some of the improvements have been successful in preventing unauthorized access, some of such improvements have also rendered the servicing of the lock assemblies difficult if not impossible.

Typical prior art attempts at improving the security of the pop-out T-handle assemblies is illustrated in U.S. Pat. No. 4,552,001 which describes in great detail the improvements in such types of lock assemblies, and further illustrates a number of other prior art patents dealing with typical pop-out T-handle assemblies. However, the pop-out T-handle assembly as disclosed in U.S. Pat. No. 4,552,001, as well as those disclosed and claimed in the related patents as set forth therein, pose a serious problem for the service industry, at least as to those persons charged with the responsibility of servicing the locks once they are in place in the field.

More specifically, it will be noted that in order to remove the cylinder housing which contains the cylinder lock and related extension rod from the device for servicing purposes, not only must the pop-out handle be activated to biasingly pop outwardly, but the cylinder front handle must be removed from the housing in order to remove the cylinder lock from the cylinder housing. In order to accomplish that function, and with reference to U.S. Pat. No. 4,522,001, it will be noted that a pair of pins denoted by the numeral 28, must be removed from the cylinder front handle in order to remove the front handle to gain access to the lock. Such servicing problems exist where, for example, the user of the machine has broken a key in the lock, or for some reason, the lock has misfunctioned. In such cases, the entire cylinder lock must be replaced in order to make the T-handle lock assembly operational once again. It has been found by servicing personnel that the difficulty of removing the driven pins from the handle has rendered such lock assemblies almost unserviceable. It will be appreciated that in order to remove driven pins from the apertures in the cylinder front handle, the service personnel must apply a thin tool against one end of the pin, and literally drive the pin out of engagement by means of a mallet or hammer. However, it will be appreciated that such pop-out handles are designed to freely rotate, and hence, it is almost impossible to strike the pins with a mallet to remove the same without causing the handle to rotate. Hence, it has been found to be difficult if not in some cases impossible to remove such pins for servicing purposes.

The purpose of the present invention is to provide an improvement in such pop-out lock assemblies such that the servicing problems attendant to such high security locks is greatly enhanced.

OBJECTS AND ADVANTAGES

It is therefore the principal object of the present invention to provide an improved handle assembly for pop-out T-handle lock assemblies which permits ease of removal of the cylinder front handle from the cylinder housing assembly in order to gain access to the lock assembly for ease of servicing.

Hence, the principal object of the present invention is accomplished by providing a pop-out T-handle lock assembly of the type having a cylinder front handle formed by a front surface, opposed side walls and a top wall and bottom wall, and having an open back end, a cylinder front handle mating with a cylinder housing which in turn, houses a cylinder lock and related extension rod therein, and wherein such a front handle is reciprocable and engageable within a handle housing for security purposes, the improvement consisting of providing an inner handle which is secured to the cylinder housing at the front end thereof, and adapted to receive the cylinder front handle in mounting engagement therewith, the inner handle having attachment means associated therewith for accommodating the attachment of the cylinder front handle thereto in disengageable engagement, and wherein the cylinder front handle is provided with a pair of opposed threaded apertures in spaced apart relation traversing the side wall thereof in position to be in registry with the attachment means formed in the inner handle when the cylinder front handle is mounted on the inner handle means. The pair of threaded screws for removably engaging the cylinder front handle to the inner handle are applied by traversing the corresponding threaded apertures in the cylinder front handle side walls, and engaging the attachment means in the inner handle such that the cylinder front handle is easily removable from the inner handle formed as a part of the cylinder housing.

In conjunction with the foregoing object, it is a further object of the present invention to provide an improved handle assembly for pop-out T-handle lock assemblies of the type described, wherein the inner handle is further provided with attachment flanges which extend outwardly from the handle, each of which includes a screw receiving channel formed therein along the inner surface thereof, such that when the cylinder front handle is disengageably mounted onto the inner handle by threading the respective threaded screws through the corresponding threaded apertures in the cylinder front handle side walls, the threaded screws traverse the screw channels in the attachment flanges thereby to securely hold the cylinder front handle to the inner handle.

In conjunction with the foregoing object, it is yet a further object of the invention to provide an improved handle assembly for pop-out T-handle lock assemblies wherein the threaded screws are provided with tamper proof screw heads of the type requiring a special tool to manipulate, such that typical tools employed with threaded screws and the like may not be employed to remove the cylinder front handle from the assembly.

Further features of the invention pertain to the particular arrangement of the parts whereby the above-outlined and additional operating features thereof are attained.

The invention, both as to its organization and method of operation, together with further objects and advantages thereof, will best be understood by reference to the following specification taken in connection with the accompanying drawings.

SUMMARY OF THE INVENTION

In summary, the present invention provides an improved handle assembly of the type employed on pop-out T-handle lock assemblies. The improvement addresses the problem of servicing locks which have malfunctioned in the field by permitting the service personnel to remove the cylinder front handle from the inner handle which carries the cylinder housing in which the cylinder lock is contained so that the cylinder lock may be removed and serviced accordingly. The present invention provides a first cylinder front handle which is disengageably mounted to an inner handle which is formed as a part of the cylinder housing, by means of a pair of threaded screws. The provision of threaded screws used in conjunction with an inner handle to mount the front handle to the inner handle eliminates the need to remove drive pins therefrom, so that the operator gains easy access to the lock for servicing purposes.

The improvement consists of providing cylinder housing with an inner handle which has a pair of attachment flanges formed thereon and extending outwardly in opposed directions, each of the attachment flanges provided with a screw receiving channel formed along the inner surface thereof. The cylinder front handle is provided with a pair of opposed threaded apertures on the opposed side walls, and are positioned such that the threaded apertures are in registry with the screw receiving channels formed in the inner handle when the cylinder front handle is mounted to the inner handle. The application of the threaded screws through the threaded apertures in the front handle will screw threadingly engage the screws through the screw receiving channels in the inner handle, and thereby secure the front handle to the inner handle. As further security, each of the threaded screws may be provided with specially designed tamper-proof screw heads of the type which require a special tool to be employed for the purpose of unscrewing the screws from their nesting apertures.

DETAILED DESCRIPTION OF THE DRAWINGS AND INVENTION

Figure 1:
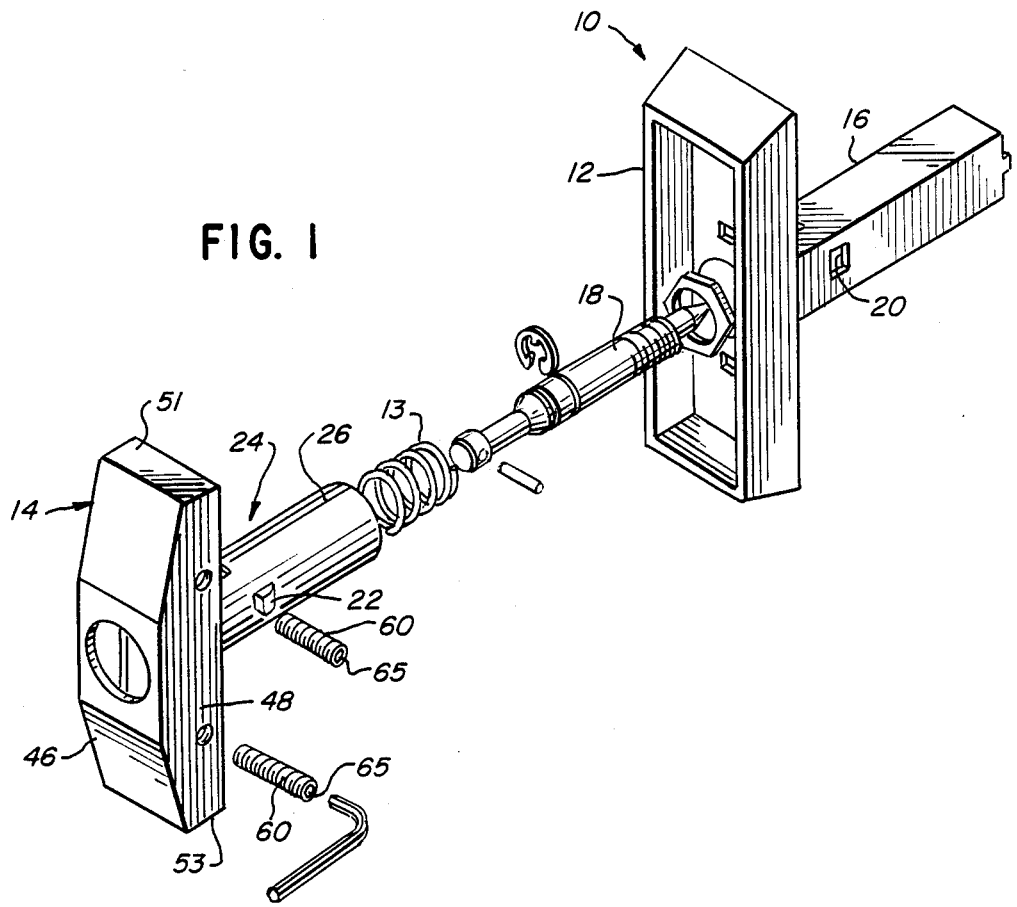
FIG. 1 is a perspective view, in exploded fashion, showing the cylinder front handle as the same is mounted on the inner handle, and the threaded screws which are employed to accomplish the mounting thereof.

As indicated hereinabove, pop-out T-handle lock assemblies are well known in the art, and are clearly demonstrated and described in U.S. Pat. No. 4,552,001. In general, the box or other device which is intended to be kept in a securely locked posture, will be built with a handle housing generally referred to by the numeral 10 secured therein. The handle housing consists of a handle enclosure 12 in which the cylinder front handle 14 will nest when in the locked position. The rear of the handle housing 10 includes a hollow shank 16 through which the threaded extension rod 18 passes to threadedly engage a threaded aperture located within the box (not shown) in a manner typically known in the art. The hollow shank 16 includes a bolt aperture 20 through which the lock bolt 22 exits for engagement purposes thereby to hold the entire handle lock assembly 24 in locked engagement within the handle housing 10.

As is typically known in the art, the lock mechanism consists of a cylinder housing 26 in which a cylinder lock 28 is engaged, the cylinder lock 28 having the threaded extension rod 18 extending outwardly from the rear end thereof.

Figure 2:
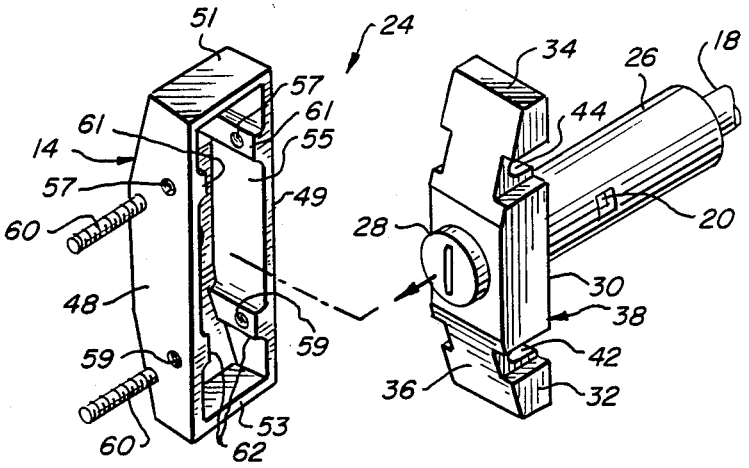
FIG. 2 is a perspective view, showing the cylinder front handle as removed from the inner handle, and showing the details of construction of the inner handle relative to the cylinder housing.

With specific reference to FIG. 2 of the drawings, the present invention provides an inner handle 30 which includes a pair of attachment flanges 32 and 34 respectively extending outwardly therefrom and in opposed directions with respect to one another. The inner handle 30 includes an outer front surface 36, and an inner surface 38, each of the attachment flanges 32 and 34 having a screw receiving channel 42 and 44 respectively formed along the inner surface 38 thereof.

It is contemplated that the inner handle 30 may be formed as a separate part with respect to the cylinder housing 26, but the same are then engaged together by means of bayonet type slots and flanges. Once assembled, the inner handle 30 and cylinder housing 26 become virtually unitary in construction and are not removable.

The cylinder front handle 14 is shown to be formed by a front wall 46, a pair of opposed side walls 48 and 49 respectively, a top wall 51 and a bottom wall 53. The cylinder front handle 14 is shown to be open at its back end as demonstrated by numeral 55.

Each of the opposed side walls 48 and 49 respectively are shown to carry a pair of spaced apart threaded apertures 57 and 59 respectively which accommodate the threaded screws 60 therethrough. It will be noted that for security purposes, the cylinder front handle 14 is provided with thickened sections 61 and 62 respectively for additional support in holding the threaded screws 60 therein. Each of the threaded screws 60 in the preferred embodiment, may be provided with tamper-proof screw heads 65 which are of the type commonly known in the art, and require a special tool in order to engage and manipulate.

As shown in FIGS. 1 and 2 of the drawings, when the cylinder front handle 14 is mounted over the inner handle 30, the same will overlie the outwardly extending attachment flangs 32 and 34 respectively. Furthermore, the respective threaded apertures 57 and 59 will come into registry with the screw receiving channels 44 and 42 respectively, such that once the threaded screws 60 are threadedly engaged between the opposed threaded apertures 57 and 59 respectively, the threaded screw 60 will pass behind the attachment flanges 44 and 42, thereby to mountingly engage the cylinder front handle 14 to the inner handle 30. It will therefore be appreciated that the engagement procedure may be easily engaged in by simply screw threading screws 60 through the appropriate apertures 57 and 59, while the same will pass behind the attachment flanges 44 and 42 respectively in order to accomplish the engagement of the cylinder front handle 14 to the inner handle 30. It will also be appreciated that the cylinder front handle 14 will be easily removeable by simply unthreading the screws 60 from the corresponding apertures, thereby to remove the cylinder front handle, and gain access to the inner handle 30 which forms a part of the entire lock assembly including the cylinder housing 26 containing the cylinder lock 28. The cylinder lock 28 may then easily be removed from the cylinder housing 26 for servicing purposes.

It will be appreciated that the assembly of the present invention eliminates the present requirement that drive pins be removed from the device in order to gain access to the lock assembly. Given the fact that the pop-out handle assemblies are designed to rotate freely, it is almost impossible to apply a punch tool to one end of a driven pin, and to use a mallet or hammer to drive the same out of engagement. Such action will actually cause the handle to freely rotate, thereby requiring the service personnel to apply some type of support surface under the handle while he uses a punch and a mallet to drive the pins out, in order to prevent the handle from rotating.

Hence, service personnel in connection with the present invention, need only tactuate the pop-out handle to be biasingly urged forward by the coil spring 13 in a manner commonly known in the art, and once in the popped out position, may then unthread the screws 60 to remove the cylinder front handle 14 from the inner handle 30. Once that function has been accomplished, free access to the cylinder lock 28 may be had, for servicing purposes.

It will therefore be appreciated from the above description and related claims hereinafter, that the present invention provides a high security pop-out T-handle lock assembly of the type generally desired in high security environments, but which eliminates the difficult servicing problems associated therewith. The present invention permits the easy removal of the front handle from the inner handle in order to provide easy access to the cylinder lock for servicing purposes.

While there has been described what is at present considered to be the preferred embodiment of the invention, it will be understood that various modifications may be made therein and it is intended to cover in the appended claims all such modifications as fall within the true spirit and scope of the invention.

I claim:

1. In a popout T-handle lock assembly of the type having a cylinder front handle formed by a front surface, opposed side walls, and a top and bottom wall having an open back end, which mates with a cylinder housing which, in turn, houses a cylinder lock and related extension rod therein, the cylinder front handle and related cylinder housing and cylinder lock with extension rod being reciprocable and engageable within a handle housing, the improvement comprising in combination, inner handle means secured to a cylinder housing at the front end thereof and adapted to receive the cylinder front handle in mounting engagement therewith, said inner handle means having attachment means associated therewith for accommodating the attachment of the cylinder front handle thereto in disengageable engagement, said cylinder front handle provided with a pair of opposed threaded apertures in spaced apart relation traversing each of the side walls thereof and positioned to be in registry with said attachment means formed in said inner handle means when the cylinder front handle is mounted onto said inner handle means, and a pair of threaded screws for removably engaging the cylinder front handle to said inner handle means, said threaded screws traversing through corresponding threaded apertures in each of the cylinder front handle side walls and engaging said attachment means in said inner handle means thereby to removably engage the cylinder front handle to said inner handle means, whereby the cylinder front handle may be easily engaged and disengaged from said inner handle means to permit easy access to the lock assembly carried in the cylinder housing for servicing purposes.

2. The improved pop-out T-handle lock assembly as set forth in claim 1 above, wherein said inner handle means comprises an inner handle, said inner handle having a pair of opposed attachment flanges extending outwardly in opposed directions therefrom and having an outer surface and opposed inner surface, and each of said attachment flanges provided with a screw receiving channel formed along the inner surface thereof, whereby the cylinder front handle may be disengageably mounted to said inner handle by threading the respective threaded screws through the corresponding threaded apertures in the cylinder front handle and traversing said screw channels and said attachment flanges.

3. The improved pop-out T-handle lock assembly as set forth in claim 2 above, wherein each of said threaded screws is further provided with tamper proof screw heads of the type requiring a special tool to manipulate.

4. In a pop-out T-handle lock assembly of the type having a cylinder front handle formed by a front surface, opposed side walls and a top and bottom wall and having an open back end, which mates with a cylinder housing which, in turn, houses a cylinder lock and related extension rod therein, the cylinder front handle and related cylinder housing and cylinder lock with extension rod being reciprocable and engageable within the handle housing, the improvement comprising in combination, an inner handle secured to the cylinder housing at the front end thereof, said inner handle having a pair of opposed attachment flanges extending outwardly and in opposed directions therefrom, said attachment flanges each having a screw receiving channel formed along the inner surface thereof, said cylinder front handle provided with a pair of opposed threaded apertures in spaced apart relation traversing each of the side walls thereof and positioned to be in registry with said screw receiving channels formed in said inner handle when said cylinder front handle is mounted onto said inner handle, a pair of threaded screws for removably engaging the cylinder front handle to said inner handle, each of said threaded screws provided with tamper proof screw heads of the type requiring a special tool to manipulate, and said threaded screws traversing through corresponding threaded apertures in each of said cylinder front handle sidewalls and within the confines of said screw receiving channels thereby to removably engage the cylinder front handle to said inner handle, whereby the cylinder front handle may be easily engaged and disengaged from said inner handle to permit easy access to the lock assembly carried in said cylinder housing for servicing purposes.

* * * * *